US008793950B2

(12) United States Patent
Hill et al.

(10) Patent No.: US 8,793,950 B2
(45) Date of Patent: Aug. 5, 2014

(54) APPARATUS FOR CONNECTING FRAMING COMPONENTS OF A BUILDING TO A FOUNDATION

(75) Inventors: Mikel S. Hill, Flowery Branch, GA (US); Brian M. Peek, Cornelia, GA (US); Joel Franklin Barker, Townville, SC (US); Ken Wilkes Hix, Bogart, GA (US); Harri Mikael Salonvaara, Jefferson, GA (US)

(73) Assignee: Huber Engineered Woods, LLC, Charlotte, NC (US)

( * ) Notice: Subject to any disclaimer, the term of this patent is extended or adjusted under 35 U.S.C. 154(b) by 0 days.

(21) Appl. No.: 13/487,377

(22) Filed: Jun. 4, 2012

(65) Prior Publication Data

US 2013/0000223 A1 Jan. 3, 2013

Related U.S. Application Data

(63) Continuation-in-part of application No. 12/649,206, filed on Dec. 29, 2009, now abandoned.

(51) Int. Cl.
*E02D 27/00* (2006.01)

(52) U.S. Cl.
USPC ..... 52/293.3; 52/283

(58) Field of Classification Search
CPC ... E04B 1/2604; E04B 1/26; E04B 2001/268; E04B 2001/2644
USPC ..... 52/293.3, 293.1, 702, 283, 254
See application file for complete search history.

(56) References Cited

U.S. PATENT DOCUMENTS

| | | | | |
|---|---|---|---|---|
| 4,449,335 | A | 5/1984 | Fahey | |
| 4,457,118 | A | 7/1984 | Bowen | |
| 5,091,235 | A | 2/1992 | Vergnano | |
| 5,513,476 | A | 5/1996 | Jones | |
| 5,561,955 | A | 10/1996 | Frobosilo et al. | |
| 5,970,665 | A | 10/1999 | Oudman | |
| 5,979,123 | A * | 11/1999 | Brockman | 52/101 |
| 6,427,390 | B1 * | 8/2002 | Thies | 52/58 |
| 6,460,308 | B1 | 10/2002 | Armstrong et al. | |
| 6,669,554 | B1 | 12/2003 | Tregidga | |
| 6,901,715 | B2 | 6/2005 | Brown et al. | |
| 7,124,544 | B2 | 10/2006 | Brown et al. | |
| 7,152,884 | B2 | 12/2006 | Herth | |

(Continued)

FOREIGN PATENT DOCUMENTS

| | | |
|---|---|---|
| EP | 1681407 | 7/2006 |
| JP | 2006046020 | 2/2006 |

OTHER PUBLICATIONS

Rim Joists, Oct. 17, 2008, oikos, http://oikos.com/library/airsealing/rim_joists.html, p. 1-3.*

(Continued)

*Primary Examiner* — Elizabeth A Plummer
(74) *Attorney, Agent, or Firm* — Gardner, Groff, Greenwald & Villanueva, P.C.

(57) ABSTRACT

An apparatus for connecting framing components of a building structure to a foundation wall includes a connector having a generally L-shaped cross-section. The connector is configured to be secured to the foundation wall. The connector has a joist shelf configured to support one or more floor joists and a ledge configured to support one or more wall sheathing panels.

20 Claims, 11 Drawing Sheets

(56) References Cited

U.S. PATENT DOCUMENTS

| | | | | |
|---|---|---|---|---|
| D549,851 | S | 8/2007 | Antonic | |
| 7,461,494 | B2 | 12/2008 | Frezza | |
| 7,975,446 | B2 * | 7/2011 | Hall et al. | 52/289 |
| 2002/0046521 | A1 * | 4/2002 | Steinacker, Sr. | 52/274 |
| 2002/0062610 | A1 * | 5/2002 | Bushberger | 52/293.3 |
| 2002/0095888 | A1 | 7/2002 | Winskye | |
| 2004/0245767 | A1 | 12/2004 | Herth | |
| 2005/0055966 | A1 | 3/2005 | Conroy | |
| 2005/0183361 | A1 | 8/2005 | Frezza | |
| 2005/0257442 | A1 | 11/2005 | Brown et al. | |
| 2006/0016139 | A1 | 1/2006 | Beck et al. | |
| 2007/0119108 | A1 | 5/2007 | Downard | |
| 2007/0175172 | A1 | 8/2007 | Sousa | |
| 2008/0022624 | A1 | 1/2008 | Hanson et al. | |
| 2008/0060295 | A1 | 3/2008 | Powanda | |
| 2008/0127584 | A1 * | 6/2008 | Schiffmann et al. | 52/293.3 |
| 2008/0179418 | A1 | 7/2008 | Brough et al. | |
| 2008/0261019 | A1 | 10/2008 | Shen et al. | |
| 2011/0067346 | A1 * | 3/2011 | Chalker et al. | 52/702 |
| 2012/0005971 | A1 * | 1/2012 | Palmeri | 52/167.1 |

OTHER PUBLICATIONS

TimberStrand LSL, Weyerhaeuser Company, iLevel, 2010, 1 pg. <http://www.ilevel.com/aboutilevel/technologies/TimberStrandLSL.aspx>.

TimberStrand LSL Treated Sill Plate, Weyerhaeuser Company, iLevel, 2009, 1 pg. <http://www.ilevel.com/walls/w_TimberStrandLSL_sillplates.aspx>.

Examination Report for Application No. MX/a/2001/001599, dated Dec. 9, 2013, Mexican Institute of Industrial Property, 2 pages.

* cited by examiner

APPARATUS FOR CONNECTING FRAMING COMPONENTS OF A BUILDING TO A FOUNDATION

TECHNICAL FIELD

The present invention is directed to an apparatus for connecting framing components of a building to a foundation.

BACKGROUND

The majority of buildings, including most single-family and multi-family residences and a large percentage of commercial, institutional, and public buildings constructed in the United States, are framed with wood. Light wood-frame construction adapts readily to the most intricate spaces and architectural forms. The typical platform framing technique, which is also the most common light framing construction technique, requires selecting, measuring, cutting, drilling, and assembling many components. Such components typically include a sill sealer, a sill plate, anchors, a rim board (or joist), joists, subfloor panels, and an optional termite shield.

Typically, the sill plates and rim boards serve as the starting point for the remainder of the construction process, as shown in FIG. 1. The sill plate L is secured to a foundation F and provides a nailing base for the other adjoining members. The rim board R is placed on-edge and on top of the sill plate L around the outer perimeter of the floor system and transfers stacking gravity loads, such as aligned bearing walls, into the foundation. The rim board R also ties the joists J together, thereby improving lateral load resistance of the structure. Subflooring panels P are secured to the joists and J and the rim board R. Once the subflooring panels P are installed, the exterior walls of the building are constructed using a bottom plate B, one or more studs S, and top plates (not shown).

Generally, the material used for the rim board is insufficiently flexible and, thus, requires fine tune adjustment to ensure planarity as it is being fastened to the joists, rim board, and adjacent rim boards. The time it takes to make the adjustments is wasteful. Additionally, the quality of materials for the sill plate supplied to the jobsite is often of questionable performance. Thus, the framers typically need to sort through the supply to locate sufficient quality boards, which takes time and is wasteful both in material and labor costs.

Proper installation of the sill plates contributes to the finished product quality. If the sill plates are installed correctly (when the sill plates and rim boards are straight and square), the remainder of the construction process will be faster as fewer adjustments are needed. Many times, however, the foundation is not constructed to the specifications required. A homeowner will see the results of a foundation that is more than ⅜ inch out of level or square since these defects translate into visible quality issues of finished materials. For example, tile grout lines will be noticeably out of square with the top of the wall, or hardwood floor boards will appear wedge shaped where the floor meets the wall. Moreover, minor errors at the foundation framing can be exaggerated at the top plate, and the roof trusses may not fit without manual racking. Thus, correcting out of square or out of level foundations typically must take place when installing the sill plate and rim board assembly.

In addition to the construction problems caused by out of level and square foundations, variations in the foundation create air-leakage points where the sill plate does not conform to the foundation. Current sill sealing practices are insufficient to provide an air tight seal between the concrete foundation and the lower surface of the sill plate. There are additional leak paths between the sill plate and the rim board and the top of the rim board and the bottom surface of the subfloor that are unaddressed in most construction practices. These leak paths allow air infiltration into the wall cavity where it greatly reduces the insulation effectiveness. These air-leakage points can lead to significant energy losses. Additional significant energy losses occur through conduction of heat energy through large structural member areas such as the rim board.

SUMMARY

Generally described, the present invention relates to apparatuses for connecting framing components of a building structure to a foundation wall. In one form, the apparatus includes a connector having a generally L-shaped cross-section that is configured to be secured to the foundation wall. The connector has a joist shelf configured to support one or more floor joists and a recessed area therein, wherein an insulation panel is adhered to the connector within the recessed area. The connector further includes a ledge, configured to support one or more wall sheathing panels, proximate the insulation panel.

In another form, the apparatus includes a plate, wherein the plate is configured to be attached to the foundation wall, and a joist support member attached to a first end of the plate. The joist support member is configured to support one or more joists. When the apparatus is secured to the foundation wall and one or more joists are supported by the joist support member, at least a portion of each joist is located at a lower elevation than the plate.

In yet another form, the apparatus includes a plate that is configured to be secured to the foundation wall and a board that extends generally perpendicularly to the plate and divides the plate into first and second sections. The first section is configured to support one or more wall sheathing panels, and the second section is configured to support one or more joists.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of example embodiments of the invention, and are not restrictive of the invention, as claimed.

DETAILED DESCRIPTION OF EXAMPLE EMBODIMENTS

Figure 1:
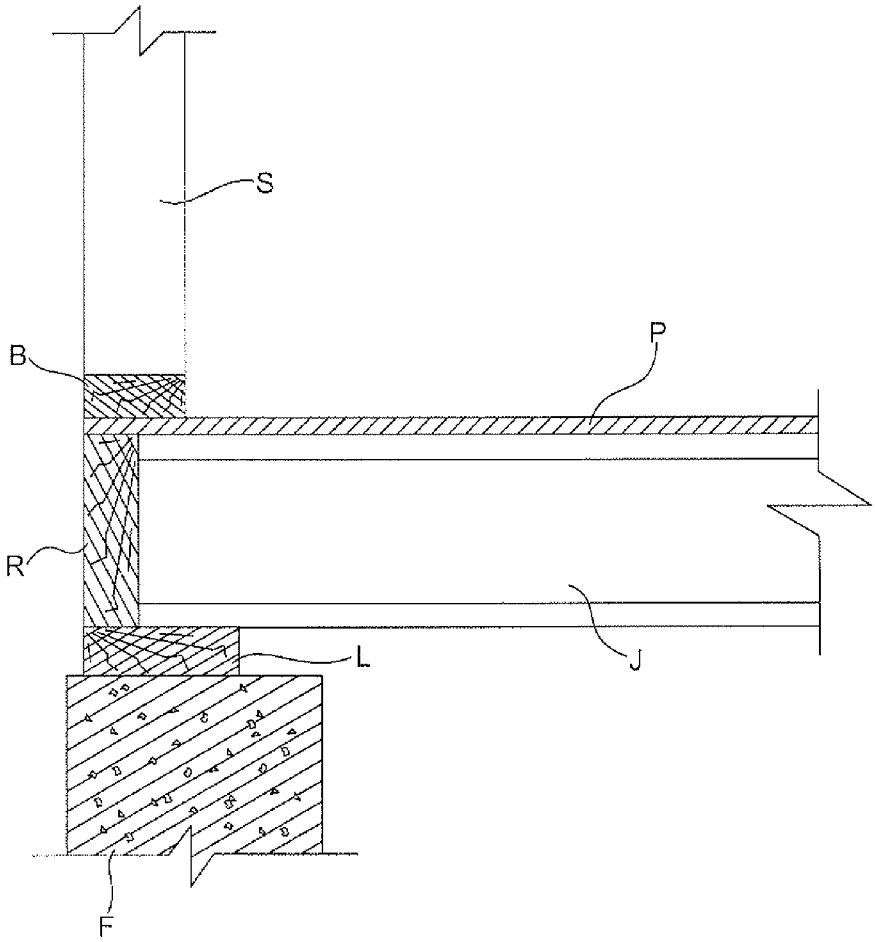
FIG. 1 (Prior Art)
FIG. 1 depicts a cross-sectional view of a conventional, prior art foundation framing system.
Figure 2:
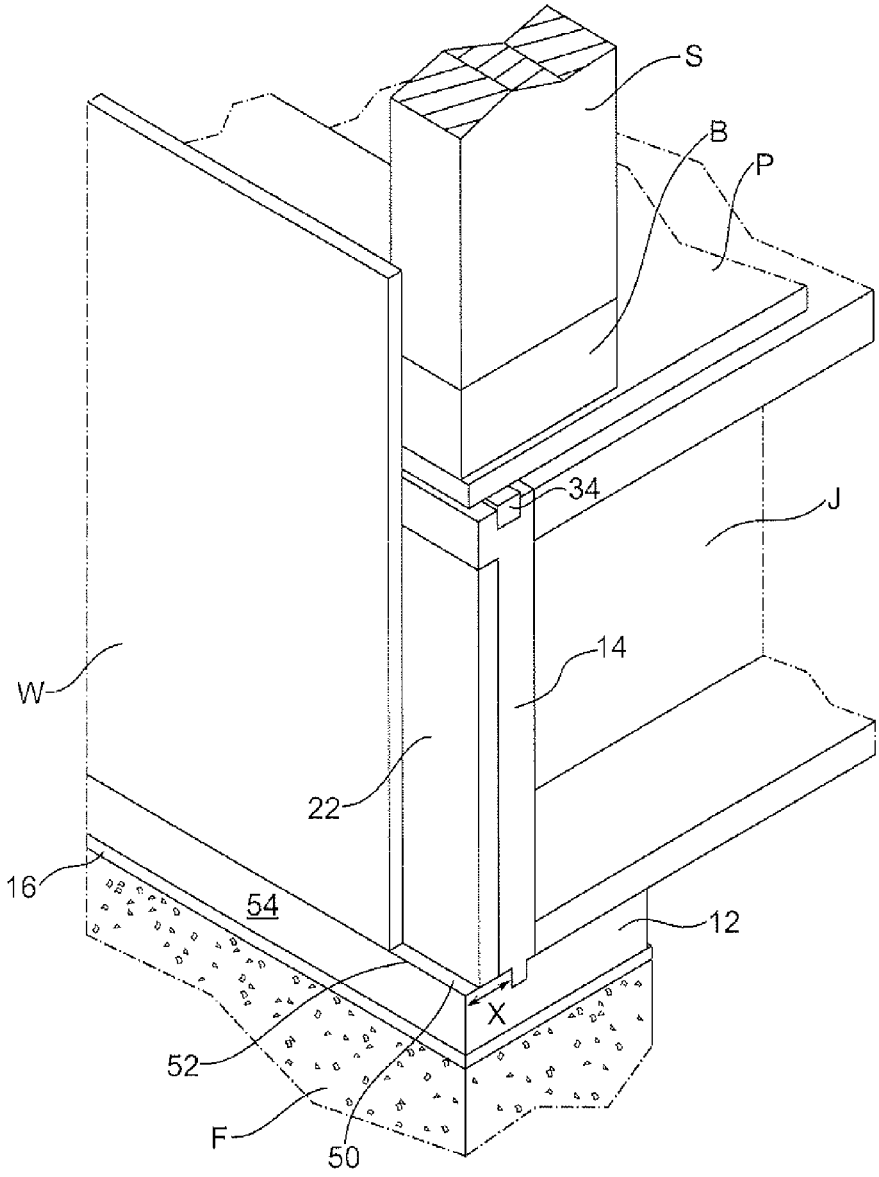
FIG. 2 depicts a perspective view of a portion of an apparatus for connecting framing components of a building to a foundation according to an example embodiment of the present invention.

The present invention may be understood more readily by reference to the following detailed description of the invention taken in connection with the accompanying drawing figures, which form part of this disclosure. It is also understood that this invention is not limited to the specific devices, methods and conditions or parameters described and/or shown herein, and that the terminology used herein is for the purpose of describing particular embodiments by way of example only and is not intended to be limiting of the claimed invention. Also, as used in the specification including the appended claims, the singular forms "a", "an" and "the" include the plural, and reference to a particular numerical value indicates at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Referring now to FIGS. 2 through 5, an apparatus or connector 10 for connecting framing components of a building, such as a residential structure, to a foundation F is shown according to a first example embodiment. The connector 10 includes a plate or horizontal member 12 and a board, panel, or vertical member 14 extending generally perpendicularly therefrom. Together, the plate 12 and the board 14 form a generally L-shaped structure. The plate 12 comprises a generally rectangular panel having dimensions in the range of 8 to 24 feet long 3½ to 7½ inches wide and 1½ to 3½ inches thick, although these ranges are exemplary and the plate can be larger or smaller, as desired. In a typical commercial embodiment, the plate 12 has dimensions of approximately 16 feet long by 5½ inches wide by 1½ inches thick.

The plate 12 further has a sill sealer layer 16 attached or adhered to its lower surface. Preferably, the sealer 16 is at least about ⅜ inch thick and has a length and width that are the same or approximately the same as the length and width of the plate 12. In alternative embodiments, the sealer 16 is larger or smaller, as desired. Preferably, the thickness of the sill sealer 16 is at least ⅜ inch to accommodate air sealing gaps found commonly in ⅜ inch out of level foundations. In a typical commercial embodiment, the sill sealer 16 comprises a closed cell polyethylene sill sealer (such as the PACTIV BUILDING GSS5055 Sill Seal Gasket), a polyethylene foam (such as Dow STYROFOAM™ SILL SEAL Foam Gasket), or a polyurethane foam (such as expanding polyurethane foam from a can), although other suitable sill sealers can be employed as well. Preferably, the plate 12 and sill sealer 16 have one or more fastening apertures or holes 18 extending therethrough. Each fastening hole 18 is configured to receive a suitably sized fastener, such as a bolt or anchor (such as the SIMPSON STRONG TIE® Mudsill Anchor in ZMAX) therethrough.

The board 14 comprises a generally rectangular board or panel having dimensions in the range of 8 feet to 24 feet long, 9½ to 16 inches wide and 1⅛ to 2 inches thick, although these ranges are exemplary and the plate can be larger or smaller, as desired. In a typical commercial embodiment, the board 14 has dimensions of approximately 16 feet long by 11⅞ inches high by 1⅛ inches thick.

Figure 3:
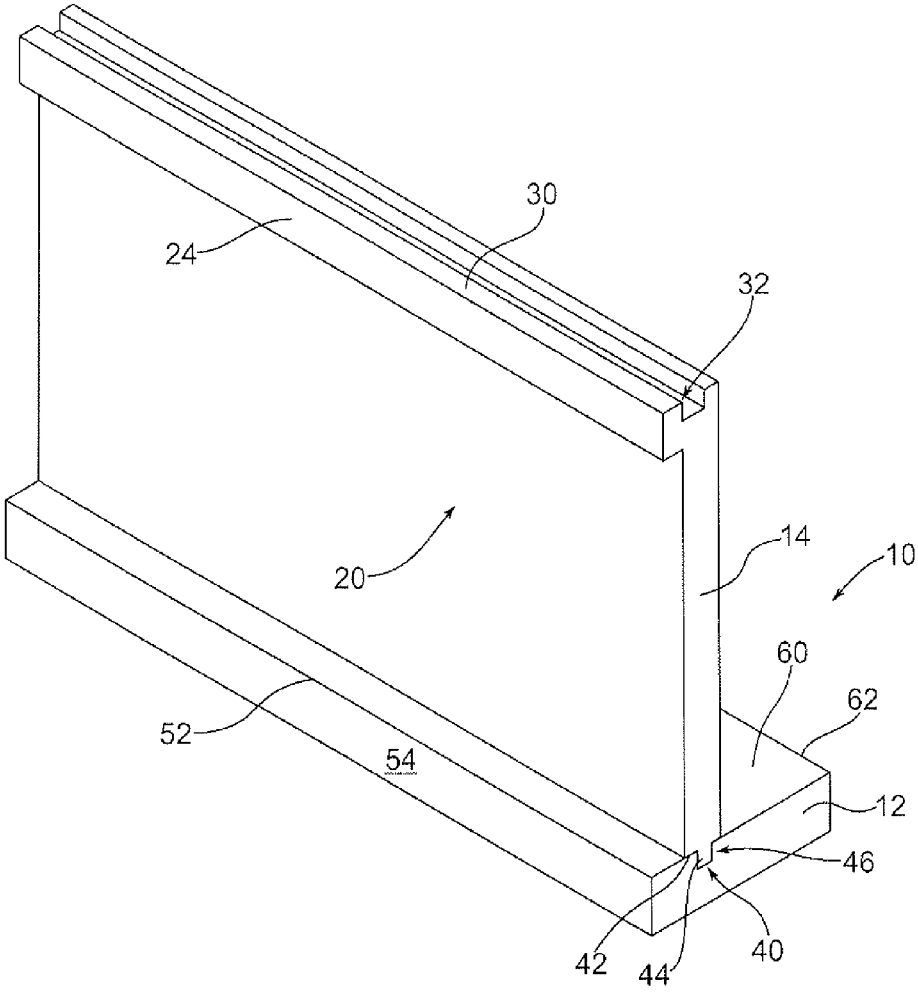
FIG. 3 depicts a perspective view of only the plate and board of the apparatus of FIG. 2.
Figure 4:
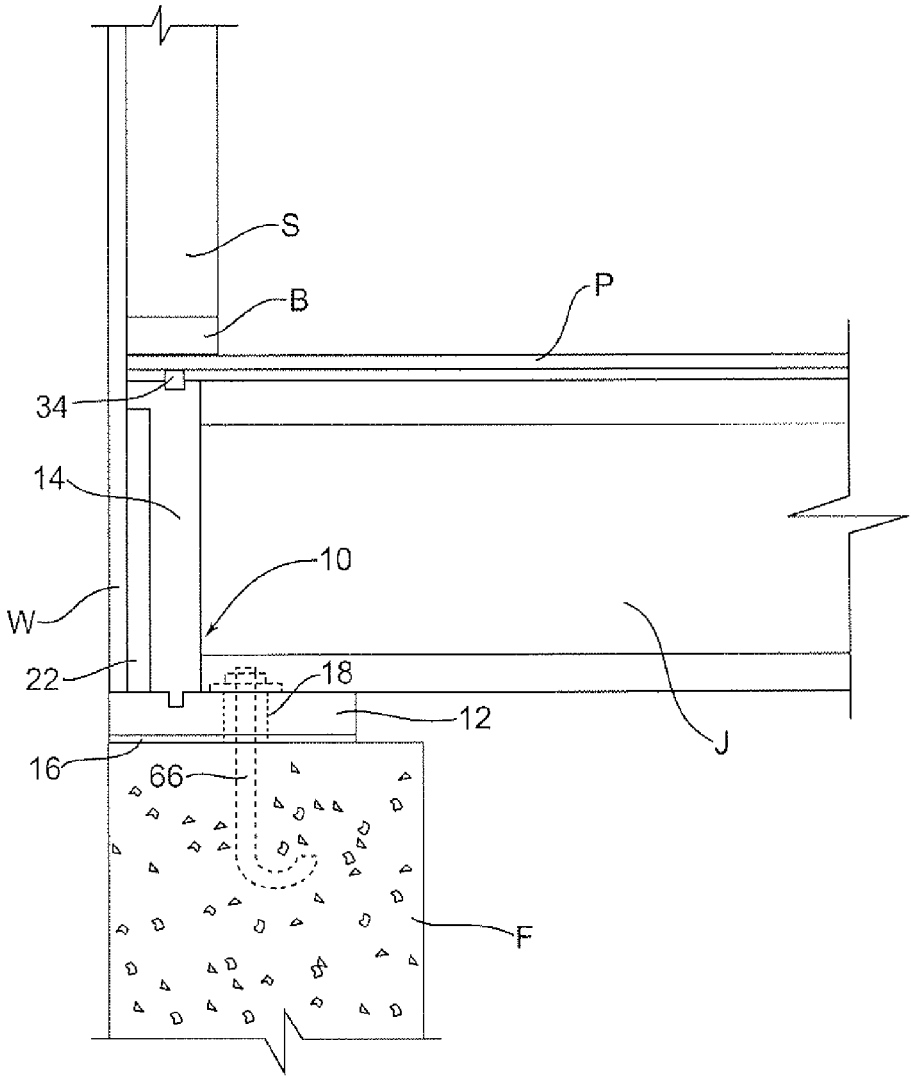
FIG. 4 depicts a side view of the apparatus of FIG. 2.

The board 14 further includes a cutout portion or recessed area or profile 20 for receiving insulation 22, as shown more clearly in FIG. 3. A pattern press platen can be utilized to impart the recessed profile 20. Preferably, the recessed profile 20 extends from lateral edge to edge and to the lower longitudinal edge. Accordingly, the board 14 includes an overhang 24 protruding from the body of board. In a typical commercial embodiment, the insulation 22 is a panel of rigid or semi-rigid foam insulation glued to the board 14 with a suitable glue or bonding agent, although in alternative embodiments, the insulation can comprise any suitable insulation. Preferably, the insulation 22 fills the entire void created by the recessed profile, although in alternative embodiments, the insulation fills only a portion of the void. The insulation 22 functions as a thermal-break to reduce heat transfer through the large band areas of the house. The insulation 22 can include, but is not limited to, Dow STYROFOAM™ extruded polystyrene, a polyisocyanurate, or a polyurethane foam that is glued or otherwise permanently or semi-permanently affixed to the board 14 within the recessed profile 20. When the insulation 22, which is typically in the form of a panel or board stock, is installed within the recessed profile 20, the combination of the board 14 and insulation 22 form a generally rectangular panel having a substantially contiguous surface. In other words, the outer-facing surfaces of the insulation panel 22 and the outer surface of the overhang 24 of the board 24 are generally flush with one another. Advantageously, the thermal insulation 22 laminated to the exterior surface of the board 14 minimizes conduction losses through this large area of the board.

Along an upper longitudinal or free edge surface 30 of the board 14 is a groove or channel 32 therein for receiving a subfloor gasket 34. In a typical commercial embodiment, the channel 32 extends the entire length of the upper longitudinal edge surface 30, although in alternative embodiments, the channel 32 can extend along a portion or portions thereof. As depicted, the channel 32 can be a generally square-shaped channel. The channel 32 is preferably filled with the subfloor gasket 34, such as a closed cell polyethylene gasket, a polyethylene foam, or a polyurethane foam, although any other suitable gasket can be employed as well. The gasket 34 reduces air infiltration between the interface between the board 14 and the subflooring panels P.

Preferably, the board 14 is permanently affixed or secured to the plate 12 a distance X from a longitudinal edge thereof. For example, the board 14 can be secured to the plate 14 with conventional fasteners or fastening techniques, such as gluing and bonding. Also preferably, to provide a secure connection between the plate and board, a tenon and groove joint 40 can be used, although in an alternative embodiment, another suitable joint can be employed. Preferably, the lower longitudinal edge surface 42 of the board 14 has a tenon 44 cut therein that mates with a suitably sized and shape groove 46 in an upper surface of the plate 12. Preferably, the groove 46 is a continuous groove extending along the length of the plate 12. In such an embodiment, the board 14 can pass through a double end tenoner. On the first or upper longitudinal edge surface 30, the groove 32 is cut to house the subfloor gasket seal 34. On the opposite edge surface (i.e., the lower longitudinal edge surface 42), the tenon 44 is cut to an appropriate size and shape to mate with the groove 46 of the plate 12. Alternatively, although less preferably, the plate can include the tenon and the board can include the groove. Preferably, a suitable glue or adhesive can be applied along the lower longitudinal edge surface 42 and the surfaces of the tenon 44 and/or to the groove 46 to further bond the board 14 to the plate 12. For example, a suitable wood adhesive can be machine applied to one or both of the plate 12 and board 14 at the joint 40 prior to joining the two members together and cured using a high frequency electric gluing machine.

The groove 46 is cut into the upper surface of the panel a distance X from the first longitudinal edge 52 of the plate 12. As depicted, the groove 46 can be a generally square-shaped groove extending the entire length of the plate 12. Typically, such a square-shaped groove 46 can be cut with a groove saw or moulder. In alternative embodiments, the groove 46 can be any suitable size and shape and can extend along only a portion or portions of the length of the plate. Preferably, the distance X is between 1 to 2 inches. In a typical commercial embodiment, the distance X is approximately 1.25 inches. Accordingly, a ledge 50 of for example approximately 7/16 inch is defined between the first longitudinal edge 52 of the plate 12 and the edge of the insulation 22 of the board 14. The ledge 50 is configured to support a wall sheathing panel W, such as a ZIP SYSTEM® brand wall sheathing panel. A commercially available ZIP SYSTEM® brand wall sheathing panel has a thickness of about 7/16 inches. In this configuration, the longitudinal face 54 of the plate 12 is positioned outwardly farther from the outer-facing surface of the recessed profile 20 than is the outer-facing surface of the overhang 24 of the board 24. As such, the recessed area or void of the recessed profile 20 is defined by the outer-facing surface of the recessed profile, the board 14 overhangs 24 (at the top), and the portion of the plate 12 that extends outwardly beyond the outer-facing surface of the board 14 (at the bottom). This portion of the plate 12 defining the bottom of the recessed area includes the plate portion supporting the insulation panel 22 and the plate ledge portion 50 for supporting the wall sheathing panels W. Thus, when a wall sheathing panel W is installed, the outer-facing surface of the wall sheathing panel is preferably flush with the longitudinal face 54 of the plate 12, and the outer-facing surfaces of the insulation panel 22 and the board overhang 24 are generally flush with one another. But, the longitudinal face 54 of the plate 12 is not flush with the outer-facing surface of the insulation panel 22, and instead extends outward from it to form the ledge 50 upon which the wall sheathing panel W is supported. Advantageously, the ledge 50 facilitates the installation of the wall sheathing panel W by freeing one hand of the framer/builder that would normally be used to hold the sheathing while concurrently fastening the sheathing to the wall studs.

In an alternative embodiment, the groove 46 is cut closer to the first longitudinal edge 52 of the plate 12 such that the outer surface of the board 14 or its insulation panel 22 is flush with the longitudinal face 54 of the plate 12. In such an embodiment, there is no ledge for a wall sheathing panel.

Figure 5:
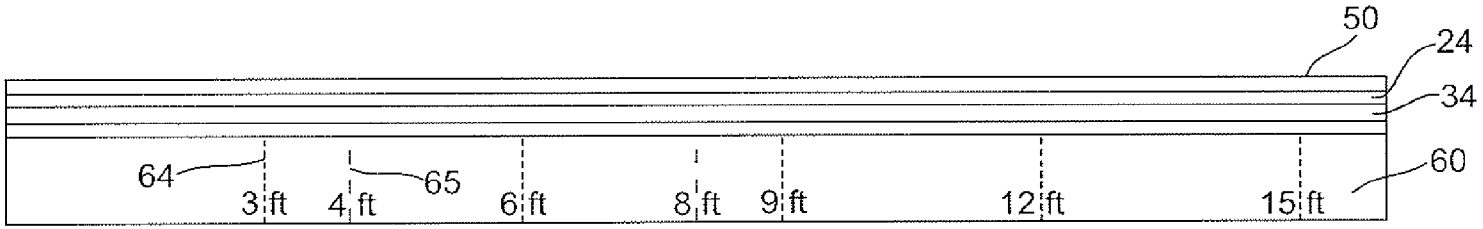
FIG. 5 depicts a top view of the apparatus of FIG. 2 and shown without the framing components.

A shelf 60 or generally flat load bearing surface is defined between the board 14 and the second longitudinal edge 62 of the plate 12. The shelf 60 is configured to receive and support one or more joists J (such as I-joists). Optionally, one or more layout lines, markings, or other suitable indicia, as shown in FIG. 5, can be marked on the shelf 60 at appropriately spaced repeating intervals to facilitate a perpendicular installation (by aligning the joists thereon). For example, a first set of layout lines 64 can be spaced 3 ft apart and/or a second set of layout lines 65 can be spaced 4 ft apart. Optionally, the distance between the lines can be marked on the shelf 60. These lines can be used in conjunction with the concept of the Pythagorean Theorem to speed installation and ensure a square foundation.

Preferably, the plate 12 and the board 14 are constructed of a wood composite material, such as, but not limited to, oriented strand board (OSB), particle board, plywood, waferboard, chipboard, medium-density fiberboard, parallel strand lumber, oriented strand lumber (OSL), and laminated strand lumber. In a typical commercial embodiment, the plate 12 comprises OSL and the board 14 comprises OSB. Preferably, both the OSB and OSL are pressure treated. Also preferably, the plate 12 and board 14 are treated to be both decay and insect resistant. Optionally, the outer surfaces of the plate 12 and board 14 can be smoothed with a single or double planar.

In still other alternative embodiments, the plate 12 and board 14 can be manufactured by encapsulating an inner structural member with a polymeric material such as in a manner that described in U.S. Patent Application Publication No. 2008/0179418, which is incorporated by reference in its entirety for all purposes. Still alternatively, the plate 12 and board 14 can comprise a wood thermoplastic composite lumber (WTCL), such as that described in U.S. Patent Application Publication No. 2008/0060295, which is incorporated by reference in its entirety for all purposes and which uses wood flour, high density polyethylene, and other processing additives. In such an embodiment, the plate 12 and board 14 can be extruded to produce the desired finished shape and dimensions.

Preferably, the connector 10 is preassembled prior to installation on the building site. In other words, the components of the connector 10 are preassembled and attached together to provide a "one-piece unit" that can be installed on a foundation. Preferably, there is no assembly of the components on the construction site. Typically, the plate 12 is cut to the appropriate size and has a groove cut along the length of the board at a distance X, which is about 1.25 inches in a typical commercial embodiment, from the longitudinal edge. The board 14 is cut to the appropriate size and shape and is passed through a double end tenoner, which cuts the tenon 44 along the lower longitudinal edge surface 42 and a channel along the upper longitudinal edge surface 30. A suitable wood adhesive can be machine applied to one or both of the plate 12 along the lower longitudinal edge surface 42 and board 14 along the upper longitudinal edge surface 30. The tenon 44 of the board 14 can then mated with the groove 46 of the plate 12 and cured using a high frequency electric gluing machine. The insulation panel 22, subfloor gasket 34, and sill sealer 16 can be manually applied using a glue line and/or self-adhesives following the assembly of the two structural members (i.e., the plate and board members).

To install the connector 10 on the foundation wall F of a building, a builder places the plate 12 of a first connector 10 on the foundation wall and inserts a bolt 66 or other suitable fastener into each of the fastening holes 18 through the plate 12 and tightens the bolts, although other suitable fasteners or fastening techniques can be employed. A second connector 10 is similarly connected to the opposing foundation wall. One or more I-joists J are installed and rest on the shelves 60 of the opposing connectors 10. The joists are nailed to or otherwise secured to the shelves of the boards 14. Following the installation of the I-joists J, one or more subflooring panels P are installed and sealed against air infiltration by the subfloor gasket 34. Once the subflooring panels P are installed, the exterior walls of the building are constructed using a bottom plate B, one or more studs S, and top plates (on top of the studs, and not shown). Once the walls are plumb and straight, one or more wall sheathing panels W are installed and rest on the ledge 50. The wall sheathing panels W improve the racking resistance of the wall. Preferably, a sealing tape such as the ZIP SYSTEM® Tape is applied to seal the seams between adjacent wall sheathing panels W and between the wall sheathing panels W and the plate 12 of the connector 10 to provide a barrier against air infiltration and to meet current International Code Council (ICC) code requirements.

Preferably, the connectors are installed on all foundation walls, although in other embodiments, the connectors are installed on only two opposing walls. In order to join adjacent connectors in a butt joint configuration, an expansion joint gasket can be used. The expansion joint gasket can comprise a closed cell polyethylene gasket, a polyethylene foam, or a polyurethane foam, although other suitable gaskets can be employed. The expansion joint gasket can be attached to the connector during the assembly of the connector, or the expansion joint gasket can be attached on site. For angled configurations, such as 90 and 135 degree angles, suitably configured corner pieces can be employed. As an alternative to corner pieces, the connectors can be mitre cut or notched and sealed with an expanding foam.

Advantageously, the connector 10 is structurally superior to resist bending loads in comparison to the currently constructed sill and rim combination. During the construction process, the added resistance to bending would facilitate a straight and level start when preparing the foundation for the joists. In addition, by combining the components into a single preassembled and generally L-shaped-connector, the potential leak paths created in the traditional framing methods are significantly reduced, if not completely eliminated. Moreover, the connector 10 automatically creates a barrier to air infiltration that meets currently proposed code requirements.

Figure 6:
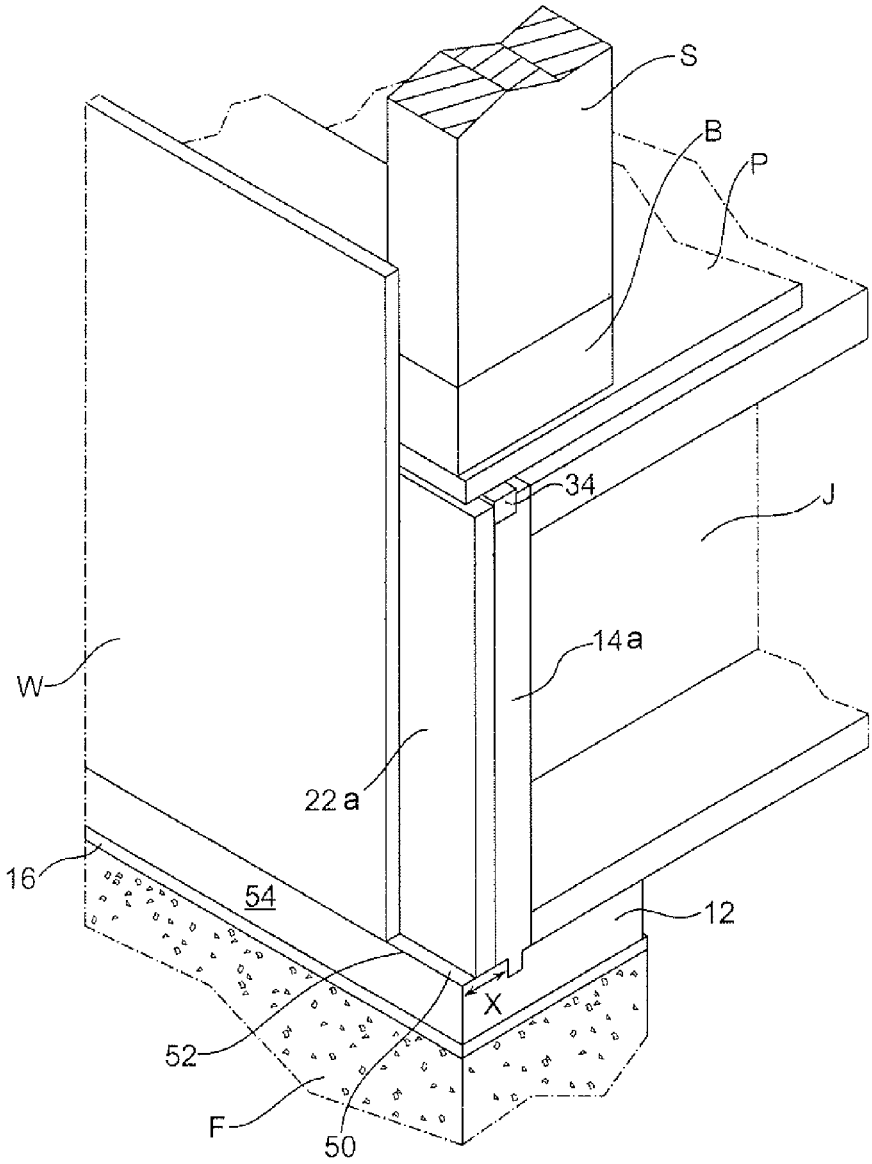
FIG. 6 depicts a perspective view of a portion of an apparatus for connecting framing components of a building to a foundation according to an alternative to the first example embodiment of FIGS. 2-5.
Figure 7:
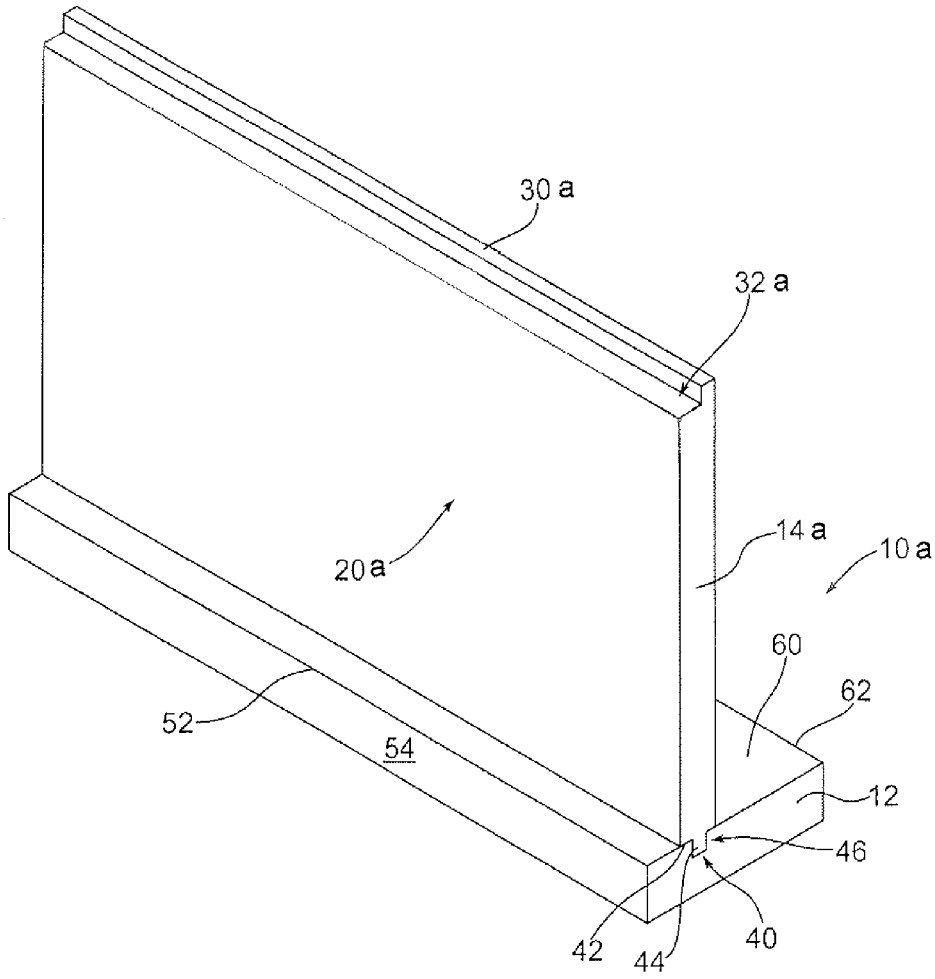
FIG. 7 depicts a perspective view of only the plate and board of the apparatus of FIG. 6.
Figure 8:
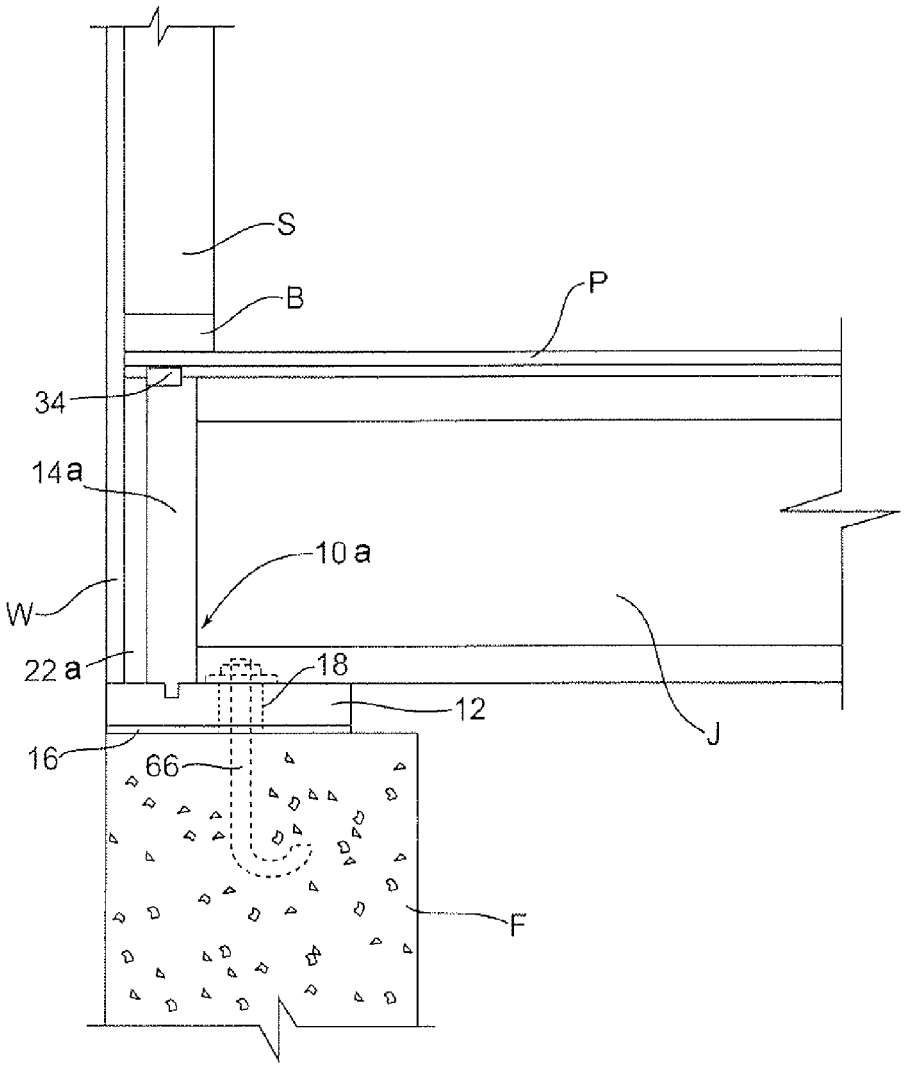
FIG. 8 depicts a side view of the apparatus of FIG. 6.

Referring now to FIGS. 6 through 8, an apparatus or connector 10*a* for connecting framing components of a building, such as a residential structure, to a foundation F is shown according to an alternative to the first example embodiment. The connector 10*a* is similar to the connector 10 of the first example embodiment in its basic construction. Thus, the connector 10*a* includes the generally horizontal plate 12 and the generally vertical board 14*a* extending generally perpendicularly therefrom, together forming a generally L-shaped body or structure. Other common or similar elements of this embodiment and the first example embodiment are identified in their respective drawings by the same reference characters.

The cutout portion or recessed profile 20*a* of the board 14*a* receives the insulation panel 22*a*. In this embodiment, the recessed profile 20*a* extends laterally edge to edge, as well longitudinally edge to edge. Accordingly, the board 14*a* does not include the board overhang 24 of the first embodiment. As such, the recessed area or void of the recessed profile 20*a* is defined by the outer-facing surface of the recessed profile and the portion of the plate 12 that extends outwardly beyond the outer-facing surface of the board 14*a* (at the bottom). This portion of the plate 12 defining the bottom of the recessed area includes the plate portion supporting the insulation panel 22 and the plate ledge portion 50 for supporting the wall sheathing panels W. In addition, because there is no board overhang 24, the insulation panel 22*a* of this embodiment can be sized and shaped to extend all the way to flush with (or just short of) the upper longitudinal edge surface 30*a* of the board 14. In this way, the insulation panel 22*a* can fill the entire (i.e., substantially all of) void of the recessed profile 20*a*. In alternative embodiments, the recessed profile is defined at least in part by one or more lateral overhangs, the insulation panel fills only a portion of the void of the recessed profile, or both.

In addition, the upper longitudinal edge surface 30*a* of the board 14*a* has the groove or channel 32*a* formed therein for receiving the subfloor gasket 34. In the depicted embodiment, the groove 32*a* has one longitudinal sidewall formed by the insulation panel 22*a*. In alternative embodiments, the recessed profile is defined at least in part by one or more lateral overhangs, the insulation panel fills only a portion of the void of the recessed profile, or both.

The connector 10*a* can be preassembled into a one-piece unit, which can then be more-easily installed during building construction, in the same way as the first example embodiment to provide the same advantages. Thus, the connector 10*a* can be installed onto the foundation wall F, then have the I-joists J installed onto the plate shelf 60, then have the subflooring panels P, bottom plate B, and studs S installed onto the board top (e.g., the upper longitudinal edge surface 30*a* and/or the subfloor gasket 34), and then have the wall sheathing panels W installed against the insulation panel 22*a* and atop the plate ledge 50.

Figure 9:
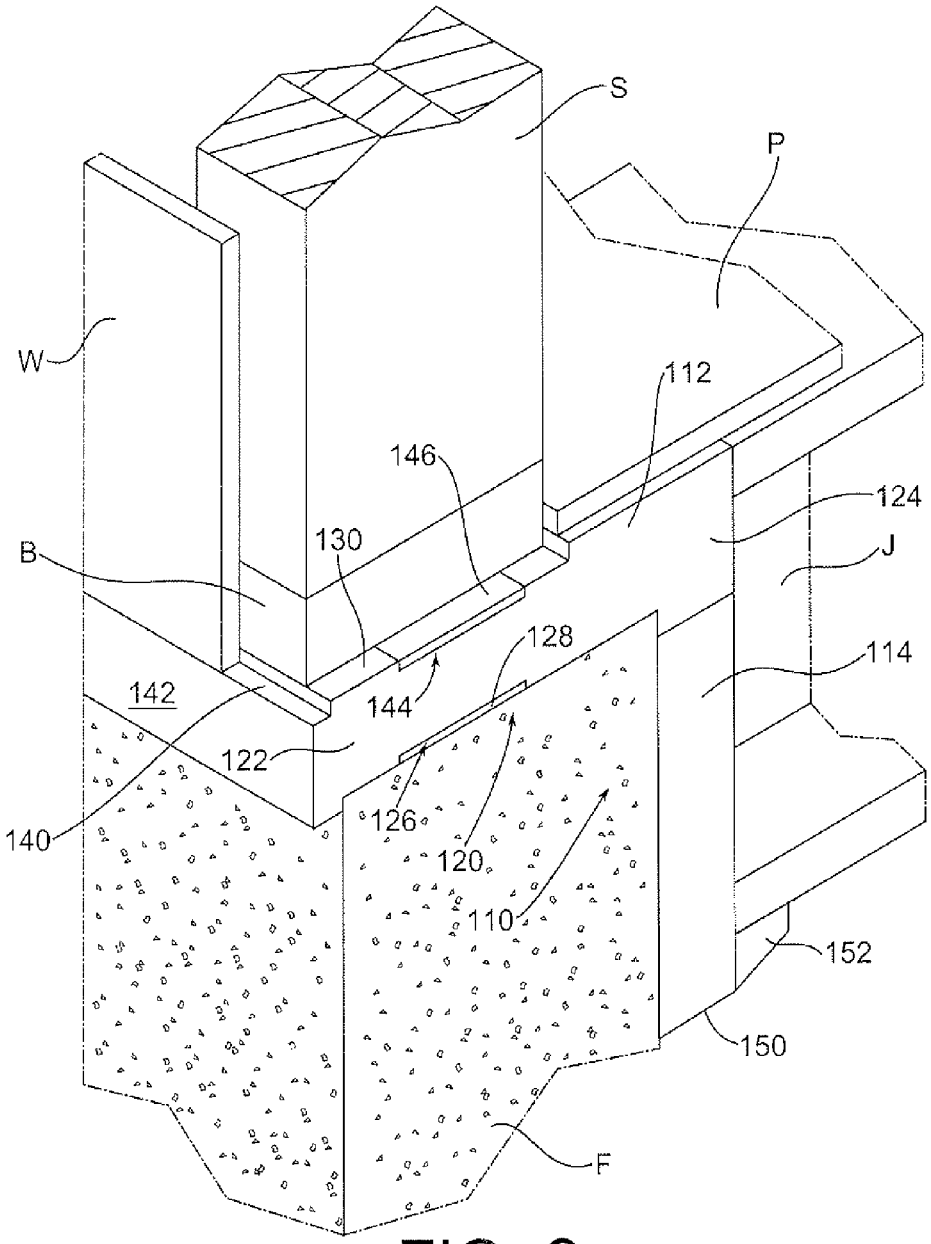
FIG. 9 depicts a perspective view of a portion of an apparatus for connecting framing components of a building to a foundation according to another example embodiment of the present invention.
Figure 10:
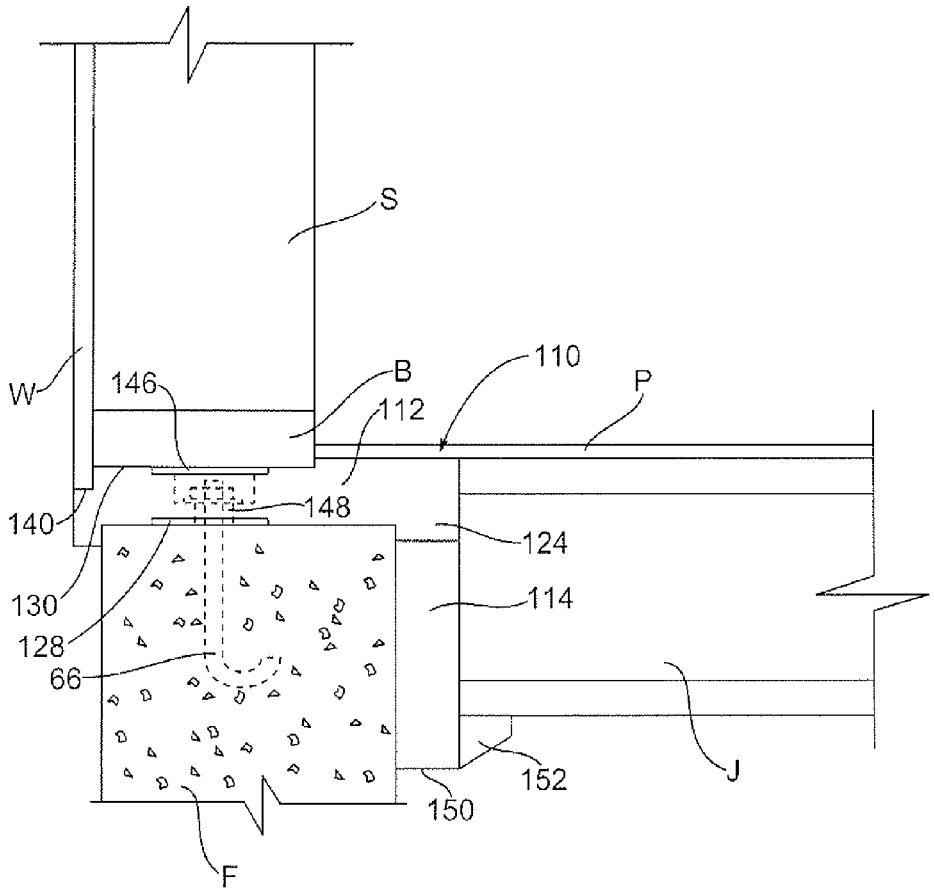
FIG. 10 depicts a side view of the apparatus of FIG. 9.

FIGS. 9 and 10 depict an apparatus or connector 110 for connecting framing components to a foundation F according to a second example embodiment. The connector 110 includes a plate or horizontal member 112 and a board, panel, or vertical member 114 extending generally perpendicularly therefrom. Together, the plate 112 and the board 114 form a generally L-shaped structure. The plate 112 comprises a generally rectangular panel having dimensions in the range of 8 feet to 24 feet long, 8 to 16 inches wide, and 1 to 3 inches thick, although these ranges are exemplary and the plate can be larger or smaller, as desired to accommodate various foundation nominal dimensions. In a typical commercial embodiment, the plate 112 has dimensions of approximately 16 feet long by 9 9/16 inches wide by 1½ inches thick.

The plate 112 includes a recessed profile 120 cut into a first major surface (i.e., the lower surface that engages the foundation wall) that extends between its lateral edges for fitting over the foundation wall F. Accordingly, the recessed profile 120 is suitably sized and shaped such that the foundation wall F fits snugly within the recessed profile and abuts longitudinal end portions 122 and 124 of the plate 112. Within the recessed profile 120 is a cutout area 126 for housing a sill sealer 128. Preferably, the recessed cutout area is approximately 5½ inches wide by ¼ inch high and runs the entire length of the plate 112, although the dimensions can vary. Preferably, the sealer 128 is at least about ⅜ inch thick and has a length and width that are the same or approximately the same as the length and width of the cutout area 126 of the plate 112. In alternative embodiments, the sealer 128 is larger or smaller, as desired. Preferably, the thickness of the sill sealer 128 is at least ⅜ inch to accommodate common ⅜ inch out of level foundations. In a typical commercial embodiment, the sill sealer 128 comprises a closed cell polyethylene sill sealer, although other suitable sill sealers can be employed as well.

The plate 112 also includes a plate shelf 130 or stepped area cut in an upper surface thereof. The plate shelf 130 is suitably sized and shaped to receive and hold a conventional base plate B and is at a lower elevation than the second longitudinal end portion 124. Preferably, the shelf 130 is approximately ¼ inch lower than the second longitudinal end portion 124. The purpose of this shelf 130 is to align the vertical wall created by the base plate B, the stud S, and the top plate with the connector 110. Proximate the plate shelf 130 is a ledge 140 extending near the edge of the first longitudinal end 122. The ledge 140 is at a lower elevation than the plate shelf 130. Preferably, the ledge 140 is approximately ¼ inch lower than the shelf 130. Also preferably, the ledge 140 is configured to support a wall sheathing panel W, such as a ZIP SYSTEM® brand wall sheathing panel. When the sheathing panel W is installed, it abuts the base plate B and stud S, and is generally flush with the outer surface 142 of first longitudinal edge portion 122 of the plate 112.

The plate shelf 130 has a cutout portion 144 therein for receiving a subfloor gasket 146. Preferably, the cutout portion 144 is approximately 5½ inches wide by ¼ inch high and runs the entire length of the plate 112, although the dimensions can vary. A plurality of fastening holes or apertures 148 extend through the subfloor gasket 146 and sill sealer 128 and are configured to receive one or more fasteners (e.g., bolts 66) therethrough for securing the connector 110 to the foundation wall F.

The board 114 extends from the lower surface of the second longitudinal edge portion 124 of the plate 112, thereby creating the general L-shape. Preferably, the board 114 and plate 112 can be separate members that are glued, bonded, or otherwise affixed together. In such an embodiment, optionally, a tenon and groove joint glued together or other suitable joint (such as discussed above with reference to the connector 10) can be used to provide a more secure connection between the plate 112 and the board 114. In an alternative embodiment, the board 114 is extruded and formed integral with the plate 112. At the opposite or distal end 150 of the board 114 is a joist shelf 152 or horizontal member projecting therefrom for supporting one or more joists J. As depicted, the joist shelf 152 is glued, bonded, or otherwise affixed to the board 114 and can include a tenon and groove joint or other suitable joint. In an alternative embodiment, the joist shelf 152 can be integral with the board 114. The joist shelf 152 can comprise a generally rectangular board having a load bearing surface with dimensions in the range of 1½ inches to 3 inches long, 8 to 24 feet wide, and 1 to 4 inches thick, although these ranges are exemplary and the joist shelf 152 can be larger or smaller as desired. In a typical commercial embodiment, the joist shelf 152 has dimensions of approximately 2 inches long, 16 feet wide, and 3½ inches thick. Optionally, one or more layout lines or other suitable indicia, similar to those of the connector 10, can be marked on the joist shelf at appropriately spaced intervals to facilitate a perpendicular installation.

Preferably, the plate 112 and the board 114 are constructed of a wood composite material or other material that is the same as or similar to the material used to construct the plate 12 and board 14 of the first connector 10. Similar to the first connector 10, preferably the plate 112 and board 114 are treated to be both decay and insect resistant.

Preferably, the connector 110 is preassembled prior to installation on the building site. In other words, the components of the connector 110 are preassembled and attached together to provide a "one-piece unit" that can be installed on a foundation wall F. Preferably, there is no assembly of the components on the construction site. Typically, the plate 112 is cut to the appropriate size and has the various cutout and recessed portions cut therein. The board 114 is cut to the appropriate size and shape and its proximal longitudinal surface is glued to the lower surface of the second longitudinal portion 124 of the plate 112. The joist shelf 152 is secured to the distal end 150 of the board with a suitable glue, bonding agent, or other fastener. The subfloor gasket 146 and sill sealer 128 can be manually applied using a glue line and/or self-adhesives following the assembly of the two structural members (i.e., the plate and board members).

To install the connector 110 on the foundation wall F of a building, a builder places the recessed profile 120 of a first connector 110 over the foundation wall and secures it thereto by inserting a bolt 66 or other suitable fastener into each of the fastening holes 148 through the plate 112 and tightening the bolts, although other suitable fasteners or fastening techniques can be employed. A second connector 110 is similarly connected to the opposing foundation wall. One or more I-joists J are installed and rest on the joist shelves 152 of the opposing connectors 110. The joists are nailed to or otherwise secured to the shelves 152 and the longitudinal surfaces of the board 114 and end portion 124 of the plate 112. Following the installation of the I-joists J, one or more subflooring panels P are installed on the second longitudinal end portion 124 of the plate 112. Once the subflooring panels P are installed, the exterior walls of the building are constructed using a bottom or base plate B that is installed on the plate shelf 130 and sealed against air infiltration by the subfloor gasket 146. One or more studs S and top plates (on top of the studs and not shown) are installed. Once the walls are plumb and straight, one or more wall sheathing panels W are installed and rest on the ledge 140. The wall sheathing panels W improve the racking resistance of the wall. Preferably, a sealing tape such as the ZIP SYSTEM® tape is applied to seal the seams between adjacent wall sheathing panels W and between the wall sheathing panels W and the plate 112 of the connector 110 to provide an air barrier and to the current approved code amendments.

Figure 11:
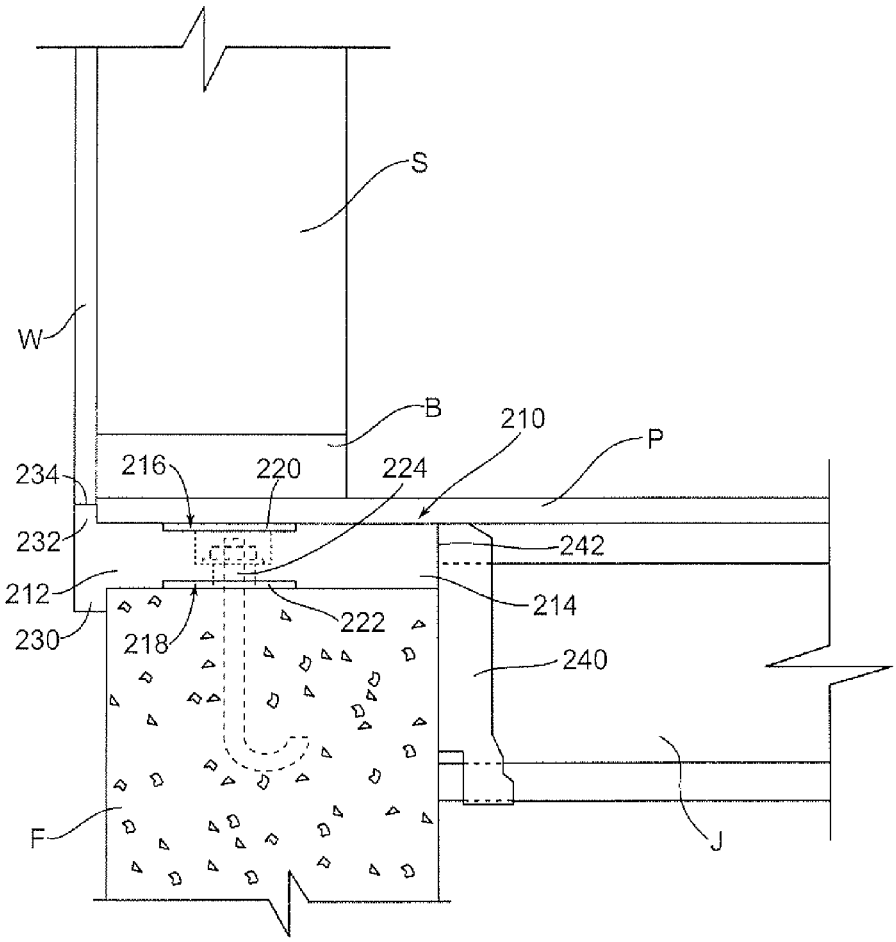
FIG. 11 depicts a side view of an apparatus for connecting framing components of a building to a foundation according to yet another example embodiment of the present invention.

FIG. 11 depicts an apparatus or connector 210 for connecting framing components to a foundation F according to a third example embodiment. The connector 210 is substantially similar to the connector 110 but with the exceptions noted herein.

The connector 210 has a generally T-shaped plate or horizontal member 212. The plate has a body member 214 with cutout portions 216 and 218 for receiving the sill sealer 220 and subfloor gasket 222, respectively. The cutout portions 216 and 218, the sill sealer 220, and the subfloor gasket 222 are substantially similar to those of connector 110. A plurality of fastener holes 224, similar to the fastener holes 148 of the connector 110, extends through the subfloor gasket and sill sealer, and each hole is configured to receive one or more fasteners (e.g., bolts 66) therethrough for securing the connector 210 to the foundation wall F.

The plate 212 includes a first flange 230 that engages the foundation wall F when installed thereto. The plate 212 also includes a second flange 232 extending oppositely from the first flange 230 to engage at least a portion of the base plate B. A wall sheathing panel W can rest on a top surface or ledge 234 of the second flange 232. Preferably, the width of the ledge 234 corresponds to the thickness of the wall sheathing panel W such that the outer-facing surface of the wall sheathing panel is flush with the outer longitudinal surface of the plate.

A plurality of conventional metal joist hangers 240 are connected to the second longitudinal edge surface 242 of the plate 212. Each joist hanger 240 wraps around the lower flange of the joist, securely holds the joist, and couples it directly to the foundation. One or more conventional fasteners can secure the joist hangers 240 to the joists J. Preferably, the joist hangers 240 are secured to the plate 212 at appropriately spaced intervals. For example, a joist hanger can be secured at every 12, 16, or 24 inches on center.

Preferably, the connector 210 is preassembled prior to installation on the building site. In other words, the components of the connector 210 are preassembled and attached together to provide a "one-piece unit" that can be installed on a foundation. Preferably, there is no assembly of the components on the construction site. Typically, the plate 212 is cut to the appropriate size having the two flanges 230 and 232 extending therefrom. A plurality of conventional metal joist hangers 240 are secured to the second longitudinal edge surface 242 with suitable fasteners (e.g., bolts) or fastening techniques. The subfloor gasket 220 and sill sealer 222 can be manually applied using a glue line and/or self-adhesives.

To install the connector 210 on the foundation wall F of a building, a builder places the plate 212 of a first connector 110 over the foundation wall such that the first flange 230 engages the foundation wall. The builder secures the plate 212 thereto by inserting a bolt 66 into each of the fastening holes 148 and tightening the bolts, although other suitable fasteners or fastening techniques can be employed. A second connector 210 is similarly connected to the opposing foundation wall. A single I-joist J is installed in each of the joist hangers 40 (and opposing hangers 40) such that each hanger wraps around the lower flange portion of the joist. One or more fasteners can be inserted through the hangers to further secure the joists to the hangers. Following the installation of the I-joists J, one or more subflooring panels P are installed and sealed against air infiltration by the subfloor gasket 220. Once the subflooring panels P are installed, the exterior walls of the building are constructed using a bottom plate B, one or more studs S, and top plates (on top of the studs, and not shown). Once the walls are plumb and straight, one or more wall sheathing panels W are installed and rest on the ledge 234 of the second flange 232 to improve the racking resistance of the wall. Preferably, a sealing tape such as the ZIP SYSTEM® tape is applied to seal the seams between adjacent wall sheathing panels W and between the wall sheathing panels W and the plate of the connector 210 to provide an air barrier and to meet the currently approved code amendments.

Advantageously, the connectors 110 and 210 fit over the foundation wall F and support the joists J in a suspended manner. These configurations greatly reduce the grade to foundation step-up height, and could, therefore, benefit a homeowner that is disabled. These configurations are also advantageous for walkout basement plans placed on sloped lots. The suspended configuration of the connectors 110 and 120 would reduce the depth of foundation excavation.

Advantageously, the connectors 10, 110, and 210 of the present invention reduce installation time on site, improve energy efficiency for the homeowner, and provide a more durable product. In typical commercial embodiments, the connectors 10, 110, and 210 can be offered in various desired sizes (for example, so as to meet the current I-joist and lumber offerings). Also advantageously, the connectors 10, 110, and 210 of the present invention can tie the wall sheathing to the foundation wall, thereby creating a stronger structure.

While the invention has been described with reference to preferred and example embodiments, it will be understood by those skilled in the art that a variety of modifications, additions and deletions are within the scope of the invention, as defined by the following claims.

The invention claimed is:

1. An apparatus for structurally connecting floor joists, subflooring panels, and wall sheathing panels of a building structure to a foundation wall of the building structure, comprising:

a single structural connector preassembled into one piece and made of a wood material, having a generally L-shaped cross-section, and configured to be secured to the foundation wall, wherein the connector has an inwardly extending joist shelf configured to directly contact and support one or more of the floor joists without the need for a separate sill plate, an upper surface configured to support one or more of the subflooring panels, an outwardly extending sheathing ledge configured to support one or more of the wall sheathing panels and positioned opposite of and coplanar with the joist shelf, and a recessed area formed therein; and an insulation panel adhered to the connector within the recessed area and integrally provided with the connector, wherein the sheathing ledge extends outwardly beyond the insulation panel.

2. The apparatus of claim 1, wherein the wood material the connector is made of comprises a wood composite material.

3. The apparatus of claim 1, where the connector comprises a sill sealer adhered to a surface thereof that engages the foundation wall.

4. The apparatus of claim 1, wherein the connector comprises a plate member and a board member extending perpendicularly from the plate member.

5. The apparatus of claim 4, wherein the plate member comprises oriented strand lumber and the board member comprises oriented strand board.

6. The apparatus of claim 1, wherein the connector includes a gasket secured within a channel along the upper surface.

7. The apparatus of claim 1, wherein the joist shelf includes one or more markings for aligning one or more floor joists thereon.

8. The apparatus of claim 1, wherein the recessed area is defined by an outer-facing surface of the connector and an upper overhang and a lower portion of the connector that extend outwardly therefrom.

9. The apparatus of claim 8, wherein the upper overhang is adjacent the upper surface configured to support one or more of the subflooring panels.

10. The apparatus of claim 1, wherein the recessed area is defined by an outer-facing surface of the connector and a lower portion of the connector that extends outwardly therefrom.

11. The apparatus of claim 10, wherein the connector includes a channel formed along the upper surface and a gasket positioned within the channel, the channel formed at least in part by the insulation panel.

12. An apparatus for connecting floor joists, subflooring panels, and wall sheathing panels of a building structure to a foundation wall of the building structure, comprising:

a single structural connector preassembled into one piece configured to be secured to the foundation wall, wherein the connector includes a generally horizontal plate member and a generally vertical board member extending perpendicularly from the horizontal plate member, an upper surface of the vertical board member configured to support one or more of the subflooring panels and at least partially defining a gasket channel, a lower surface of the horizontal plate member configured to be supported on the foundation wall, an inwardly extending joist shelf configured to support one or more of the floor joists without the need of a separate sill plate and defined by an inner portion of the horizontal plate member extending inwardly beyond an inward-facing surface of the vertical board member, an outwardly extending sheathing ledge configured to support one or more of the wall sheathing panels, positioned opposite of and coplanar with the joist shelf, and defined by an outer portion of the horizontal plate member extending outwardly beyond the outward-facing surface of the vertical board member, and a recessed area defined by the outward-facing surface of the vertical board member and the sheathing ledge of the horizontal plate member that extends outwardly therefrom; and an insulation panel abutting and adhered to the outward-facing surface of the vertical board member, positioned within the recessed area, supported by the sheathing ledge, and integrally provided with connector, wherein the sheathing ledge includes a portion that extends outwardly beyond the insulation panel and that supports the wall sheathing panels, and the gasket channel of the board member is formed at least in part by the insulation panel.

13. The apparatus of claim 12, wherein the connector comprises a wood composite material.

14. The apparatus of claim 12, wherein the horizontal plate member comprises oriented strand lumber and the vertical board member comprises oriented strand board.

15. The apparatus of claim 12, where the connector comprises a sill sealer adhered to the bottom surface of the horizontal plate member that engages the foundation wall.

16. The apparatus of claim 12, further comprising the gasket provided secured within the gasket channel of the vertical board member.

17. The apparatus of claim 12, wherein the joist shelf includes one or more markings for aligning one or more floor joists thereon.

18. The apparatus of claim 12, wherein the gasket channel has a bottom sidewall formed by the vertical board member, an innermost sidewall formed by the vertical board member, an outermost sidewall formed by the insulation panel, and an open top through which the received gasket is exposed to and contacted by the subflooring panel when assembled into the building structure.

19. An apparatus for structurally connecting floor joists, subflooring panels, and wall sheathing panels of a building structure to a foundation wall of the building structure, comprising:

a single structural connector preassembled into one piece and made of a wood material, having a generally L-shaped cross-section, and configured to be secured to the foundation wall, wherein the connector has an inwardly extending joist shelf configured to directly contact and support one or more of the floor joists without the need for a separate sill plate, an upper surface configured to support one or more of the subflooring panels, an outwardly extending sheathing ledge configured to support one or more of the wall sheathing panels and positioned opposite of and coplanar with the joist shelf, and a recessed area formed therein; and an insulation panel adhered to the connector within the recessed area and integrally provided with the connector, wherein the sheathing ledge extends outwardly beyond the insulation panel, and wherein the recessed area is defined by an outer-facing surface of the connector and an upper overhand and a lower portion of the connector that extend outwardly therefrom.

20. The apparatus of claim 19, wherein the upper overhand is adjacent the upper surface configured to support one or more of the subflooring panels.

* * * * *